US005898944A

United States Patent [19]

Vrany

[11] Patent Number: 5,898,944

[45] Date of Patent: May 4, 1999

[54] ATHLETIC GLOVE FOR GRIPPING BATS, CLUBS AND RACQUETS

[76] Inventor: David A. Vrany, 21880 Valiant Dr., Brookfield, Wis. 53045

[21] Appl. No.: 08/966,089

[22] Filed: Nov. 7, 1997

[51] Int. Cl.[6] ..... A41D 19/00

[52] U.S. Cl. ..... 2/161.4; 2/160; 2/161.1; 2/162; 2/163

[58] Field of Search ..... 2/159, 160, 161.1, 2/161.2, 161.4, 161.5, 161.6, 163, 16, 17, 20

[56] References Cited

U.S. PATENT DOCUMENTS

| | | | |
|---|---|---|---|
| 4,000,903 | 1/1977 | Swanson | 273/166 |
| 4,400,831 | 8/1983 | Rietz | 2/161.1 |
| 4,561,122 | 12/1985 | Stanley et al. | 2/20 |
| 4,590,625 | 5/1986 | Keim | 2/161 |
| 4,720,279 | 1/1988 | Fritschen et al. | 2/161.1 |
| 4,730,354 | 3/1988 | Saito | 2/161 |
| 4,777,666 | 10/1988 | Beverlin | 2/161.5 |
| 4,793,005 | 12/1988 | Hetzel, Jr. | 2/161.1 |
| 4,977,621 | 12/1990 | Richard | 2/20 |
| 5,028,050 | 7/1991 | Freyer | 273/183 |
| 5,033,119 | 7/1991 | Wiggins | 2/161 |
| 5,170,508 | 12/1992 | Kawada | 2/161 |
| 5,298,001 | 3/1994 | Goodson | 482/23 |
| 5,353,440 | 10/1994 | Meldeau | 2/161.1 |
| 5,634,213 | 6/1997 | Grover | 2/162 |

*Primary Examiner*—John J. Calvert
*Assistant Examiner*—Larry D. Worrell, Jr.
*Attorney, Agent, or Firm*—Quarles & Brady

[57] ABSTRACT

A glove for gripping a piece of athletic equipment to be swung by an athlete includes a glove shell formed by a palm portion, a back portion, a thumb portion and four finger portions. The palm and back portions form an opening through which the athlete inserts a hand. A palm strap extends across the palm portion, and has one end attached proximate to the opening and another end with holes through which the two middle finger portions project. A protrusion is attached transversely to the palm strap at a location proximate to the holes and toward the one end, thereby forming a section of the palm strap between the protrusion and the opening for wrapping around the piece of athletic equipment to be swung. A wrist strap is provided to secure the glove shell about a wrist of the athlete.

11 Claims, 2 Drawing Sheets

ATHLETIC GLOVE FOR GRIPPING BATS, CLUBS AND RACQUETS

BACKGROUND OF THE INVENTION

The present invention relates to gloves which aid an athlete in gripping and swinging a bat, club, racquet or other athletic equipment; and more particularly to gloves which are useful in playing golf.

Golfers often wear gloves when swinging the golf club in order to strike the ball with greater precision. Similarly, baseball players wear gloves to more firmly grip the bat and gloves are used in racquet sports for similar purposes. Such gloves are designed to eliminate blisters, calluses and generally to protect the hand, in addition to improving the grip. They also avoid problems caused by perspiration.

Since grip is an important aspect of many sports, presently available gloves for this purpose are extremely thin to enhance the feel of the object being swung. This combination of grip and feel is considered by many to add power to the hand, for example when playing golf, tennis, or other sports. The design of prior athletic gloves has concentrated on the use of special fabrics and pads sewn on the inside of the fingers and the palm to improve the grip.

SUMMARY OF THE INVENTION

An object of the present invention is to provide a glove to improve gripping a piece of athletic equipment being swung by the wearer of the glove.

Another object is to provide such a glove with elements that transfer forces, produced while swinging the piece of athletic equipment, from the hand of the athlete to the wrist.

These and other objectives are satisfied by a glove which includes a shell having a palm portion, a back portion, a thumb portion and four finger portions. The palm and back portions form an opening through which the person inserts a hand. The finger portions are divided into two outer finger portions and two middle finger portions.

A palm strap extends across the palm portion and parts of the two middle finger portions. The palm strap has a first end section that is attached to the palm portion proximate to the opening, and a second end section coupled to the two middle finger portions. For example, the second end section has a pair of apertures through which the two middle finger portions project. A protrusion, such as a rod or roll of glove material for example, extends transversely across the palm strap proximate to where the palm strap is coupled to the two middle finger portions. A section of the palm strap is defined between the protrusion and the opening for wrapping around the piece of athletic equipment.

A bat, club, racquet or other type of sports equipment typically exerts maximum power on a ball being struck when the equipment being swung has a whipping motion. The desired whipping motion is defeated by an athlete gripping the sports equipment too tightly, as often occurs to overcome the forces exerted on the hand by the swinging sports equipment. The present glove transfers those forces through the palm and wrist straps to the athletes's wrist, rather than through the hand where, such forces can work against the ability to properly grip the sports gear. This enables the athlete to grip the sports equipment in a manner that allows the proper whipping action.

DETAILED DESCRIPTION OF THE INVENTION

Figure 1:
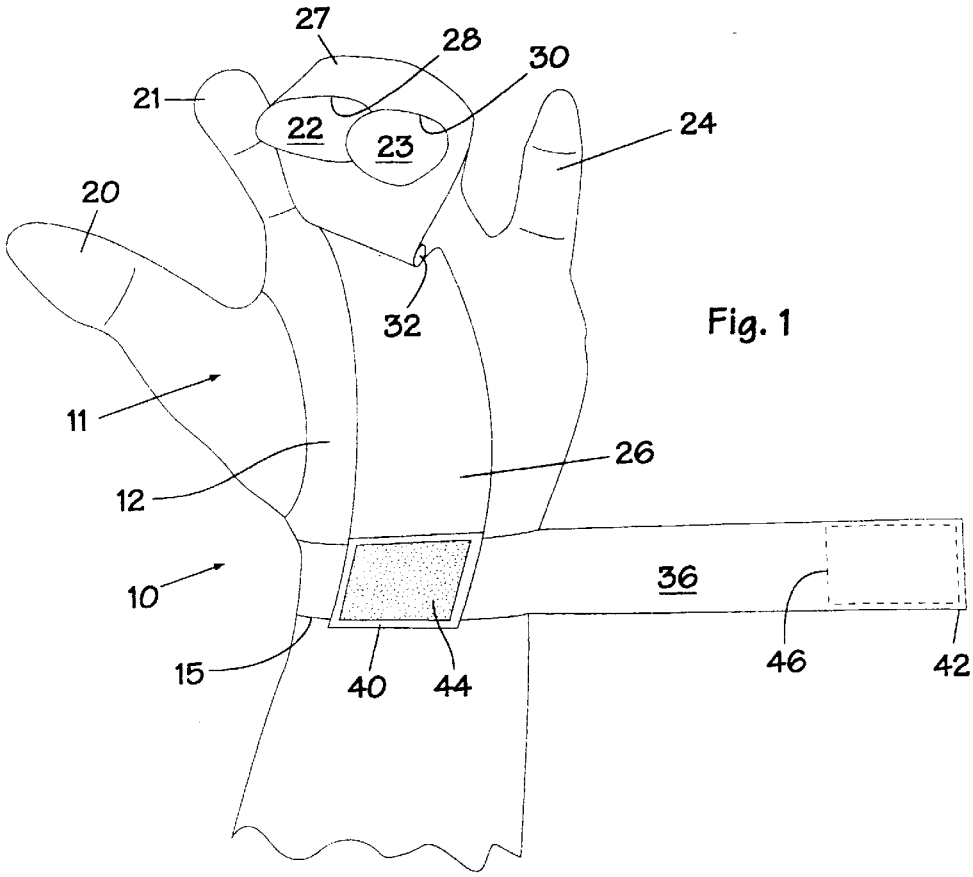
FIG. 1 illustrates the palm side of an athletic glove according to the present invention.
Figure 2:
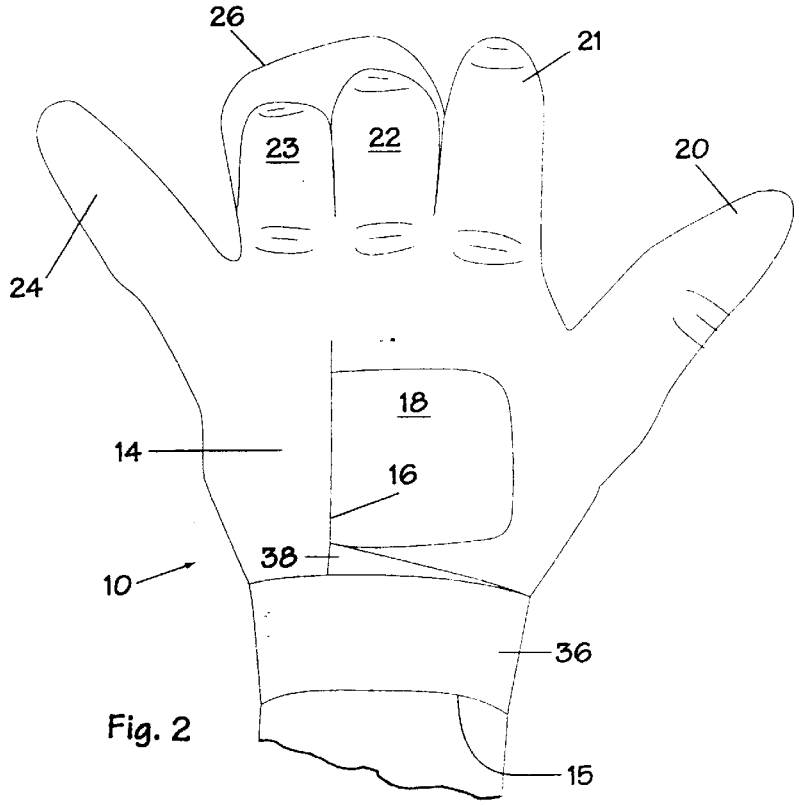
FIG. 2 represents the opposite, or back side, of the glove.

With initial reference to FIGS. 1 and 2, an athletic glove 10 is shown for use in gripping a piece of sporting equipment, such as a golf club, racquet, bat or the like, which is swung during sports play. The glove 10 has a shell portion 11 formed by a palm portion 12 that extends across the palm of the athlete's hand when worn, and a back portion 14 extending across the opposite side of the hand. The palm and back portions 12 and 14 form an opening 15 through which the athlete inserts a hand. The back portion has a slit 16 extending from the opening so that the glove may be expanded when pulled onto the athlete's hand. One side of the slit 10 has a closure tab 18 sewn thereto which projects across the slit 16 and is secured to the opposite side of the back portion 14 by an appropriate fastening mechanism, such as hook and loop material. The slit 16 and closure tab 18 enables the glove 10 to be placed snugly around the palm and back of the athlete's hand.

The glove shell 11 also includes a thumb portion 20, into which the athlete's thumb is inserted, and four finger portions 21, 22, 23 and 24. The four finger portions consist of two outer finger portions 21 and 24 for the index and smallest fingers, respectively, and two middle finger portions 22 and 23 which receive the middle and ring finger of the hand. The thumb and finger portions 20-24 are integral with the palm and back portions 12 and 14. Conventional materials and fabrication techniques can be utilized to produce the glove shell. Of particular merit are materials that will permit the piece of athletic equipment to be swung without slipping.

A palm strap 26 of leather or similar non–slippage material has one end attached, by thread, adhesive or another mechanism, to the palm portion 12 adjacent opening 15. The palm strap 26 extends in an unfastened manner across the palm section 12 and parts of the two middle finger portions 22 and 23. Alternatively, the palm portion 12 may be fastened, such as by sewing, for one to two inches across the palm section 12 beginning at the opening 15. In the preferred embodiment, the other end 27 of the palm strap 26 has a pair of apertures 28 and 30 through which the two middle finger portions 22 and 23, respectively, are inserted. The apertures 28 and 30 are sized so that the tips of the finger portions 22 and 23 will fit snugly therethrough thereby being coupled to the palm strap 26. Although the palm strap 26 has a separate hole 28 and 30 for each of the two middle fingers 22 and 23, a single hole large enough to receive both finger portions could be employed. Alternatively, this remote end 27 of the palm strap 26 could be sewn or attached by other mechanisms to the middle finger portions 28 and 30 near the tip of each finger. The palm strap 26 preferably is fabricated of leather or other material which will enable the wearer to grip and swing athletic equipment without slippage.

The palm strap 26 has a protrusion 32 which extends transversely across substantially the entire width of the strap. The protrusion 32 is located on the surface of the palm strap 26 which faces the finger portions and is proximate to the finger apertures 28 and 30 on the side toward opening 15. Preferably, the protrusion 32 is cylindrical formed by a rod or roll of material approximately one centimeter in diameter. Such a rod or roll may be fastened to the palm strap 26 by adhesive or a loop of material which extends about the protrusion and is sewn to the palm strap. Although the protrusion 32 preferably has a cylindrical shape, other shapes may be utilized, such as ones which conform to the surface of the piece of athletic equipment to be grasped by the glove 10.

Figure 3:
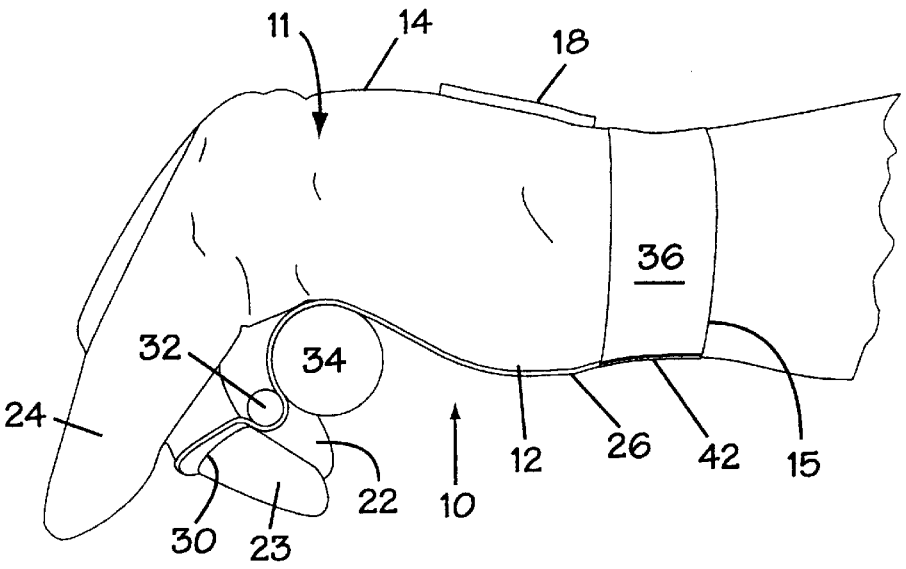
FIG. 3 is a side view of the glove worn by an athlete who is gripping a golf club.

As seen in FIG. 3, a glove 10 of this type can be worn on the upper hand of a golfer when grasping a club 34. In this case the protrusion 32 fits between the club 34 and the finger portions of the glove. Typically, the two middle fingers of the athlete project through the holes 28 and 30 so that the third phalanx of each finger extends completely through the strap and the protrusion 32 rests between the club and the second phalanx of the athlete's middle fingers. This configuration transfers the weight and force exerted by the golf club 34, or other piece of athletic equipment, through the palm strap 26 to the user's wrist, thereby relieving those forces from the fingers and palm of the hand and increasing the security of the grip.

Figure 4:
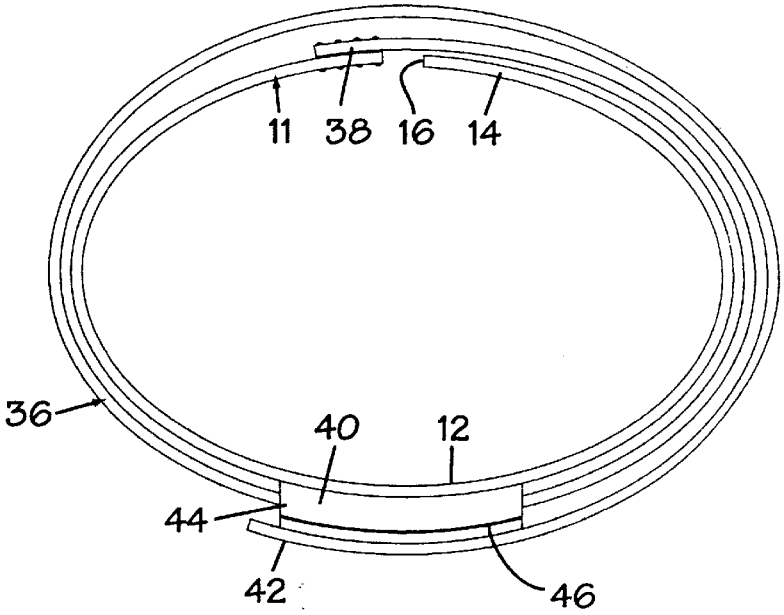
FIG. 4 is a view of the opening into the glove.

With reference to FIGS. 1 and 4, the glove 10 is secured about the wrist of the athlete by a wrist strap 36 which has one end 38 that is sewn or otherwise secured to the back portion 14 of the glove shell 11. The wrist strap 36 wraps around the thumb side of the glove and passes through a loop 40 formed at the point at which an end of the palm strap 26 is secured to the palm portion 12 of the glove shell 11. The wrist strap 36 projects outward from the opposite side of the loop 40 and continues to be wrapped around the opening 15 of the glove shell and thus around the wrist of the athlete. The free end 42 of the wrist strap 36 overlaps the loop 40. A fastener, such as a conventional hook and loop fastening mechanism for example, is provided to secure the free end 42 to the loop 40. In this case, a first pad 44 of either the hook or loop material is secured by adhesive or sewing to the outer surface of the loop 40, and second pad 46 of the mating type of hook or loop material is similarly secured at the free end 42 of the wrist strap 42. Thus the second pad 46 engage a first pad 44 when the wrist strap 36 is tightly wound around the glove shell opening 15, as shown in FIG. 4. The use of a hook and loop fastener has the advantage of easy adjustment to accommodate wrists of different sizes. However, alternative types of adjustable fastening mechanisms can be utilized to tightly secure the wrist strap 36 about the athlete's wrist.

A golf club is properly gripped in the fingers of the golfer's hand, rather than the palm. Such gripping allows the hinging and unhinging of the wrist for maximum power and allows the club to "whip" through the ball. This desirable whipping action is prevented by a golfer gripping the club too tightly in response to the forces exerted on the hand by a swinging club. Because the wrist strap is tightly secured about the user's arm, the forces exerted while swinging the golf club 34 or other sports gear are transferred through the palm strap 26 and wrist strap 36 to the athletes's wrist rather than through the athlete's hand where, such forces can work against the ability to properly grip the sports gear. As a consequence of the present glove design, the forces are removed from the athlete's hand thus increasing the ability to grip and control the club, bat, or racquet being swung.

I claim:

1. A glove for gripping a piece of athletic equipment which is swung by a person wearing the glove, the glove comprising:

a glove shell having a palm portion, a back portion, a thumb portion and four finger portions consisting of two outer finger portions and two middle finger portions, the palm and back portions forming an opening through which the person inserts a hand;

a palm strap having a first end section attached to the palm portion proximate to the opening and having a second end section coupled to at least one of the four finger portions wherein the palm strap extends across the palm portion, and having a protrusion proximate to where the palm strap is coupled to the at least one of the four finger portions thereby forming a section of the palm strap between the protrusion and the opening for wrapping around the piece of athletic equipment;

a loop connected to the palm strap; and a wrist strap for wrapping around the opening to secure the glove shell about a wrist of the person, the wrist strap attached to the back portion of the glove shell and passing through the loop thereby engaging the palm strap, and the wrist strap having a fastener for holding the wrist strap in place.

2. The glove as recited claimed in claim 1 further comprising a wrist strap attached to the glove shell for wrapping around the opening to secure the glove shell about a wrist of the person, and having a fastener for holding the wrist strap in place.

3. The glove as recited claimed in claim 2 wherein the fastener comprises hook and loop material.

4. The glove as recited claimed in claim 5 wherein the fastener has a first element attached to the wrist strap; and a second element attached to the loop and which mates with the first element.

5. The glove as recited claimed in claim 1 wherein palm strap has at least one aperture through which the at least one finger portion projects.

6. The glove as recited claimed in claim 1 wherein palm strap is coupled to the two middle finger portions.

7. The glove as recited claimed in claim 1 wherein palm strap has a first aperture through which one of the middle finger portions projects; and a second aperture through which another one of the middle finger portions projects.

8. The glove as recited claimed in claim 1 wherein the protrusion has a cylindrical shape extending transversely to the palm strap.

9. A glove for gripping a piece of athletic equipment which is swung by a person wearing the glove, the glove comprising:

a glove shell having a palm portion, a back portion, a thumb portion and four finger portions consisting of two outer finger portions and two middle finger portions, the palm and back portions forming an opening through which the person inserts a hand;

a palm strap extending across the palm portion, and having a first end section attached to the palm portion proximate to the opening and having a second end section with at least one aperture through which the two middle finger portions project, and with a protrusion at a location proximate to the at least one finger hole and toward the first end section thereby forming a section of the palm strap between the protrusion and the opening for wrapping around the piece of athletic equipment to be swung;

a loop attached to the palm portion of the glove shell proximate to the opening; and a wrist strap attached to the glove shell for wrapping around the opening to secure the glove shell about a wrist of the person, the wrist strap having a first end portion attached to the back portion of the glove shell and passes through the loop, and having a fastener for holding the wrist strap in place.

10. The glove as recited claimed in claim 9 wherein the fastener comprises a first element attached to the loop, and a second element attached to the wrist strap for mating with the first element.

11. The glove as recited claimed in claim 9 wherein the protrusion has a cylindrical shape extending transversely to the palm strap.

* * * * *